US007303115B1

(12) United States Patent
McClymont

(10) Patent No.: US 7,303,115 B1
(45) Date of Patent: Dec. 4, 2007

(54) CUPCAKE CRATE

(76) Inventor: Lee Anne McClymont, 4820-734 Girard Lanev, Raleigh, NC (US) 27613

( * ) Notice: Subject to any disclaimer, the term of this patent is extended or adjusted under 35 U.S.C. 154(b) by 0 days.

(21) Appl. No.: 11/308,797

(22) Filed: May 5, 2006

Related U.S. Application Data

(60) Provisional application No. 60/597,669, filed on Dec. 16, 2005.

(51) Int. Cl.
*B65D 5/00* (2006.01)
*B65D 25/04* (2006.01)

(52) U.S. Cl. ..... 229/120.32; 206/489; 206/562; 206/565; 229/152; 229/176; 229/906

(58) Field of Classification Search ..... 229/120.28, 229/120.32, 152, 178, 906
See application file for complete search history.

(56) References Cited

U.S. PATENT DOCUMENTS

| | | | | |
|---|---|---|---|---|
| 1,499,369 | A * | 7/1924 | Holland | 229/120.32 |
| 2,707,587 | A * | 5/1955 | Wittstein | 229/125.19 |
| 3,014,633 | A * | 12/1961 | Tarmina | 229/154 |
| 3,899,119 | A * | 8/1975 | Roccaforte | 206/562 |
| 4,114,760 | A * | 9/1978 | Entenmann | 206/562 |
| D348,378 | S | 7/1994 | Crane | D7/610 |
| D365,502 | S | 12/1995 | Runge | D7/610 |
| 5,725,146 | A * | 3/1998 | Luberto | 229/120 |
| 5,967,323 | A | 10/1999 | Siragusa | 206/499 |
| 6,003,671 | A | 12/1999 | McDonough et al. | 206/493 |
| D436,502 | S | 1/2001 | Brock et al. | D7/610 |
| 6,450,341 | B1 * | 9/2002 | Krupa et al. | 206/497 |
| 6,450,343 | B1 * | 9/2002 | Arnaldi | 206/769 |
| 6,851,601 | B1 * | 2/2005 | Montoya | 229/120 |
| 6,898,140 | B2 | 5/2005 | Leung et al. | 365/222 |
| 2001/0054570 | A1 * | 12/2001 | Danko | 206/756 |
| 2002/0079357 | A1 * | 6/2002 | Tulkoff | 229/120.32 |

* cited by examiner

*Primary Examiner*—Gary E Elkins
(74) *Attorney, Agent, or Firm*—Ishman Law Firm P.C.

(57) ABSTRACT

A cupcake carrier for organizing and protecting cupcakes during storage and transit includes a container formed of a singled sheet of planar material and having flaps folded in assembly to form an upwardly opening cavity carrying an insert tray formed of a single sheet of planar material and having circular openings for lightly compressively holding the cupcakes in a grid array. The insert is sized smaller than the base of the container to provide slots about the periphery. The container includes a hinged lid having flaps that enter the slots in the closed position to reinforce the outer walls and prevent inner movement of the flaps during transit and storage.

6 Claims, 6 Drawing Sheets

CUPCAKE CRATE

RELATED APPLICATION

This application claims the benefit of U.S. Provisional Application No. 60/597,669 filed on Dec. 16, 2005.

FIELD OF INVENTION

The present invention relates to food storage containers and, in particular, to a container for carrying edible goods such as cupcakes.

BACKGROUND OF THE INVENTION

Cupcakes are extremely popular foods and oftentimes elaborately decorated for festive occasions such as parties, birthdays, sporting events and the like. For convenience and disposability, consumers are generally relegated to using available household items like boxes, bags, and the like for transport. Therein, the goods are commingled in the available base space and are subject to moving, crushing, turning and spilling, all of which can destroy the decorations before arrival at the consuming site.

Various containers are available for holding edibles, such as cupcakes, muffins and like discrete preformed food items, in single or multiple array such as disclosed in U.S. Pat. No. 6,898,140. At the retail level, preformed plastic containers for holding single or multiple articles are common. At the consumer level, specialized carriers have been proposed such as disclosed in U.S. Pat. Nos. 6,003,671; 5,967,323; D436,502; D365,502; and D348,378. These containers tend to be manufactured of rigid molded and relatively expensive materials, designed for repetitive uses. When taken to outside events, the components may become separated and lost. Before reuse, the components require cleaning and maintenance for further uses. Accordingly, it would be desirable to provide a carrier for such articles that is inexpensive, protective of the goods, and disposable.

SUMMARY OF THE INVENTION

The present invention provides a disposable cupcake carrier formed of two panels of sheet material which are compactly folded for shipping and storage, and readily assembled as needed to provide a container for organizing decorated cupcakes and preventing shifting and resultant damage during transit and storage. The carrier includes an outer container member formed of a single sheet of planar disposable material, such as cardboard, that is folded and assembled to provide a cavity sealed by a hinged lid. An insert tray, also formed of a single sheet of planar disposable material includes a grid array of circular openings for lightly compressing and retaining the cup cakes against movement. The tray is supported above the container base by folded side flaps. The tray is smaller than the container base providing slots at the periphery. The cover includes folded side and front flaps that are retained in the slots in the closed position, thereby reinforcing the container side walls and preventing inward movement of the flaps that could damage the cupcakes in storage or transit. After use, the container may be disposed or disassembled and compactly stored for reuse.

Accordingly, it is an object of the invention to provide a carrier for preformed edibles that may be compactly stored and readily assembled to organize and protect the edibles during storage and transit.

Another object of the present invention is to provide a disposable carrier for cupcakes assembled from sheets of disposable planar materials.

A further object of the invention is to provide a carrier for cupcakes or other edible preformed articles assembled from sheets of cardboard material that are assembled to provide a container that organizes and protects the cupcakes and may be safely discarded or reused.

BRIEF DESCRIPTION OF THE DRAWINGS

The above and other features and advantages of the present invention will become apparent upon reading the following description of the preferred embodiments taken in conjunction with accompanying drawings in which.

DETAILED DESCRIPTION OF THE PREFERRED EMBODIMENTS

Figure 1:
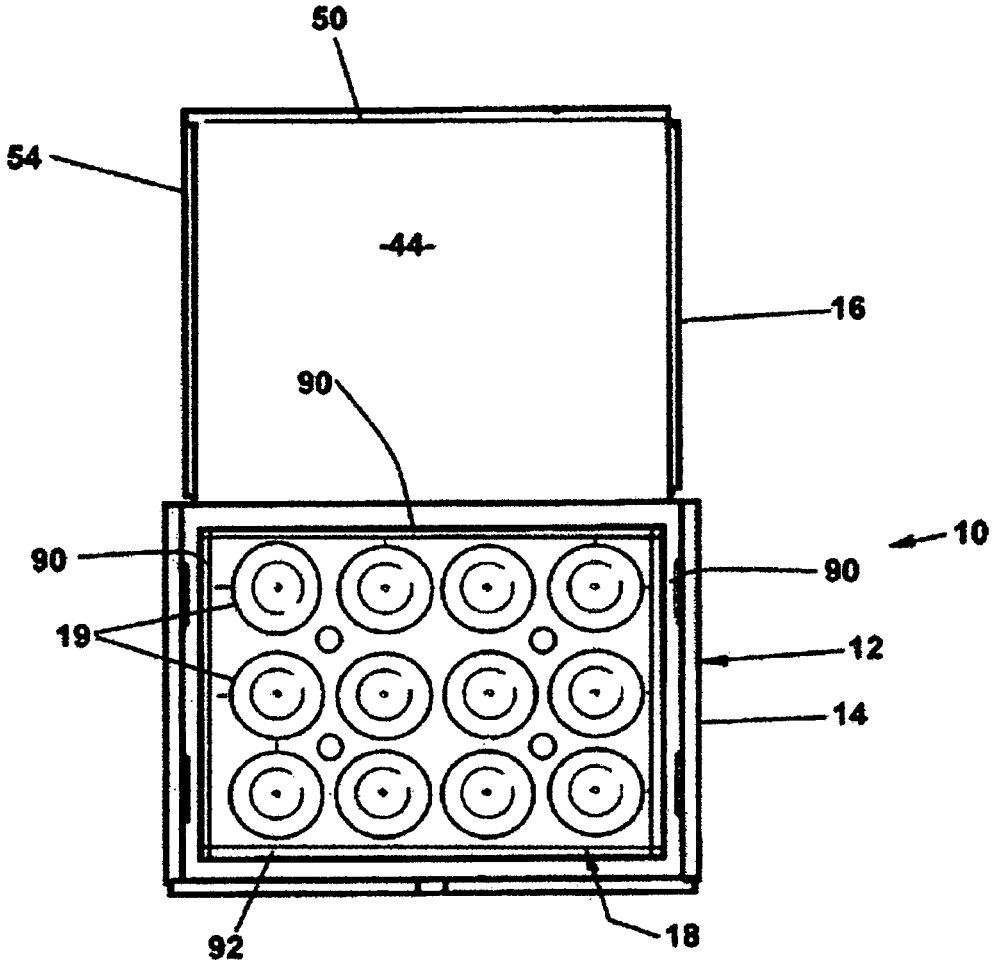
FIG. 1 is a top view of a cupcake carrier in the open position in accordance with an embodiment of the invention.
Figure 10:
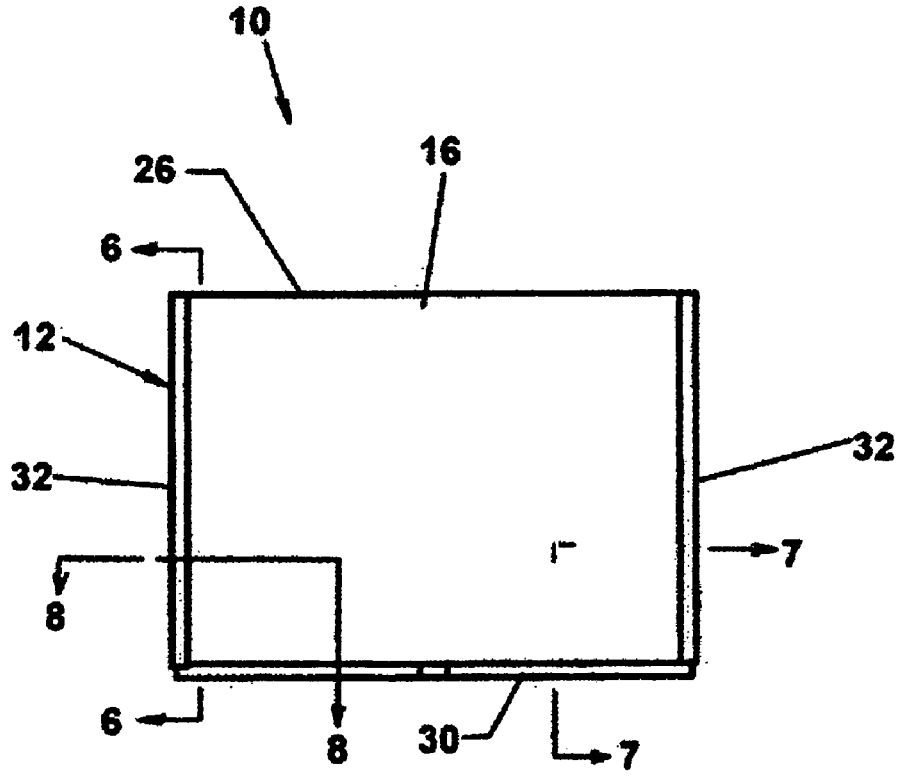
FIG. 10 is a plan view of the cupcake carrier in the assembled closed position.

Referring to FIG. 1, there is shown a cupcake carrier 10, in the open position, having an outer container or carton 12 having a base 14 and folding lid 16 carrying in a upwardly opening cavity a nesting insert tray 18 supporting an array of cupcakes 19 or other preformed edibles, such as muffins or the like. Referring to FIG. 10, in the illustrated closed position, the cupcake carrier 10 may be used for the transport and storage of the cupcakes, in an organized and safe mode as described herein.

Figure 2:
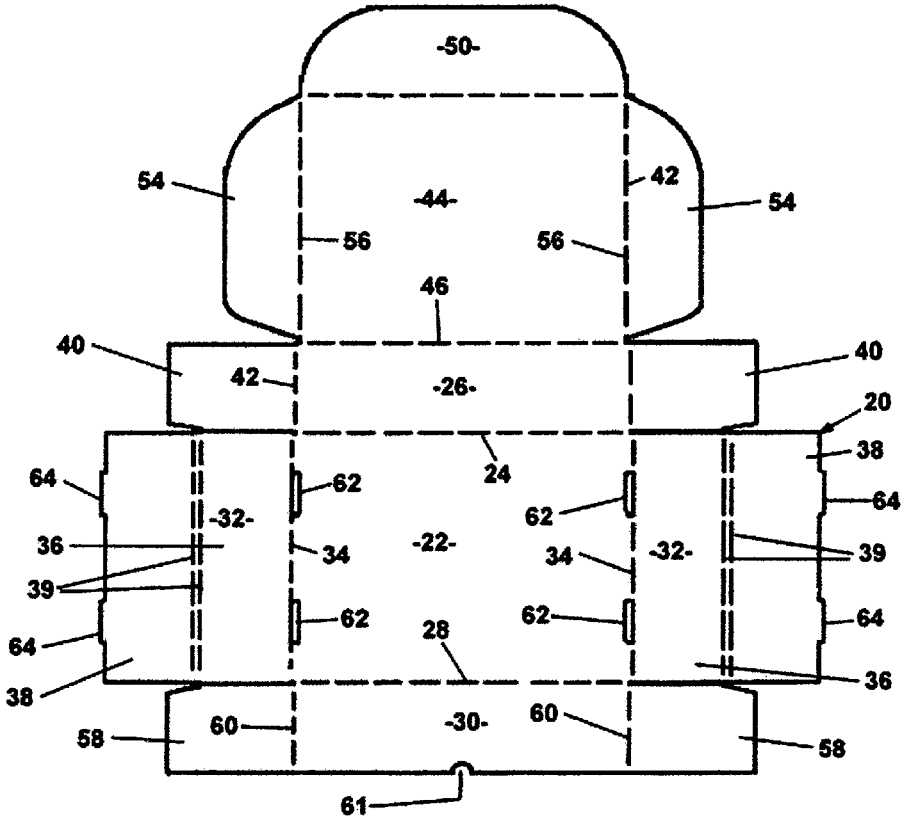
FIG. 2 is a plan view of the outer carton blank for the cupcake carrier of FIG. 1.

Referring to FIG. 2, the outer carton 12 is formed from a planar carton blank 20 of suitable disposable material such as cardboard. The blank 20 comprises a rectangular base panel 22 hingedly connected at an upper end by a lateral score line 24 to a rectangular rear panel or flap 26 and hingedly connected at a lower end by lateral score line 28 to a rectangular front panel or flap 30. Further, the base panel 22 is hingedly connected at the lateral sides to side panels 32 by transverse score lines 34. The side panels 32 include an inner panel section 36 and an outer panel section 38. The sections 36 and 38 are hingedly connected at transverse double score lines 39.

The rear panel 26 is hingedly connected to rear side flaps 40 at transverse score lines 42. The rear panel 26 is hingedly connected to a cover panel 44 at lateral score line 46.

The top panel 44 is hingedly connected at an upper end to a cover flap 50 at lateral score line 52 and to cover side flaps 54 at transverse score lines 56.

The front panel 30 is hingedly connected to front side flaps 58 at transverse score lines 60.

The base panel 22 includes transversely spaced slots 62 at score lines 34 for receiving in locking relationship outwardly projecting transversely spaced tabs 64 formed at the outer ends of the sections 38.

Figure 7:
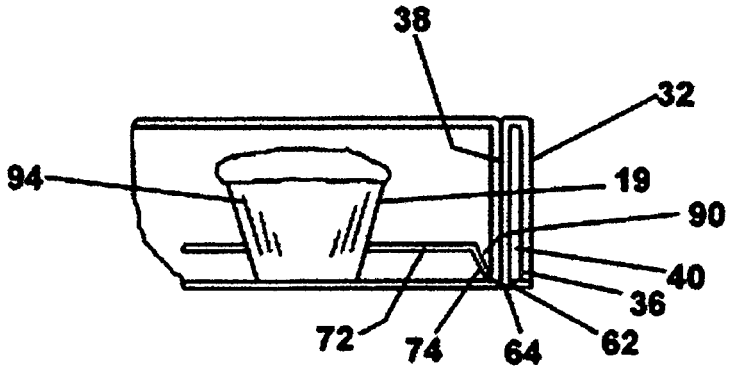
FIG. 7 is a cross sectional view taken along line 7-7 of FIG. 10.

Referring to FIGS. 6 through 10, the outer carton 10 is assembled by upwardly folding the panels 26, 32, and 30 about the base panel 22 along their respective score lines thereby forming a rectangular perimeter wall. The flaps 58 of the front panel 30 and the flaps 40 of the rear panel 26 are folded inwardly about their respective score lines and inwardly adjacent the inner surface of the side panels 32. Referring to FIG. 7, the outer section 38 of the side panels 32 is folded downwardly about score lines 39 and the tabs 64 inserted in the slots 62 thereby locking the flaps 40 and 58 without supplemental fastening with tape or adhesive and providing a reinforced perimeter wall resisting inward movement that could damage the carried goods. In the open position, the side flaps 54 and cover flap 50 of the cover panel 44 are folded inwardly, and the cover panel 44 folded about score line 46 at the rear panel 26 thereby allowing the lid 14 to move between the fully and partially open positions of FIGS. 1 and 9, and the closed position of FIG. 10.

Figure 3:
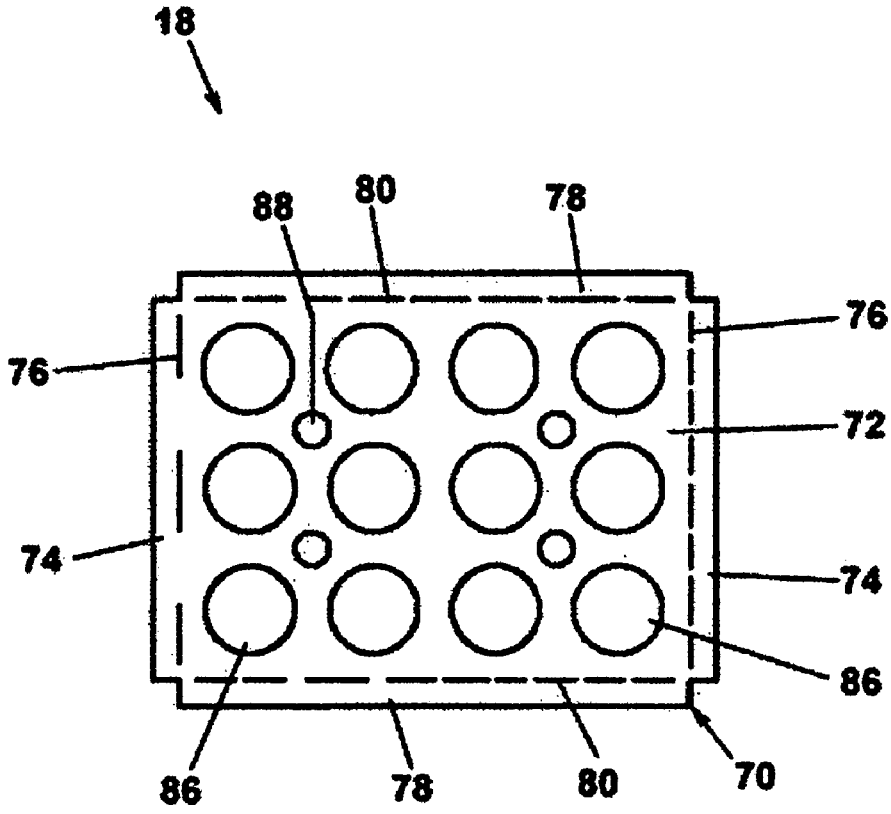
FIG. 3 is a plan view of the insert blank for the cupcake tray of FIG. 1.
Figure 4:
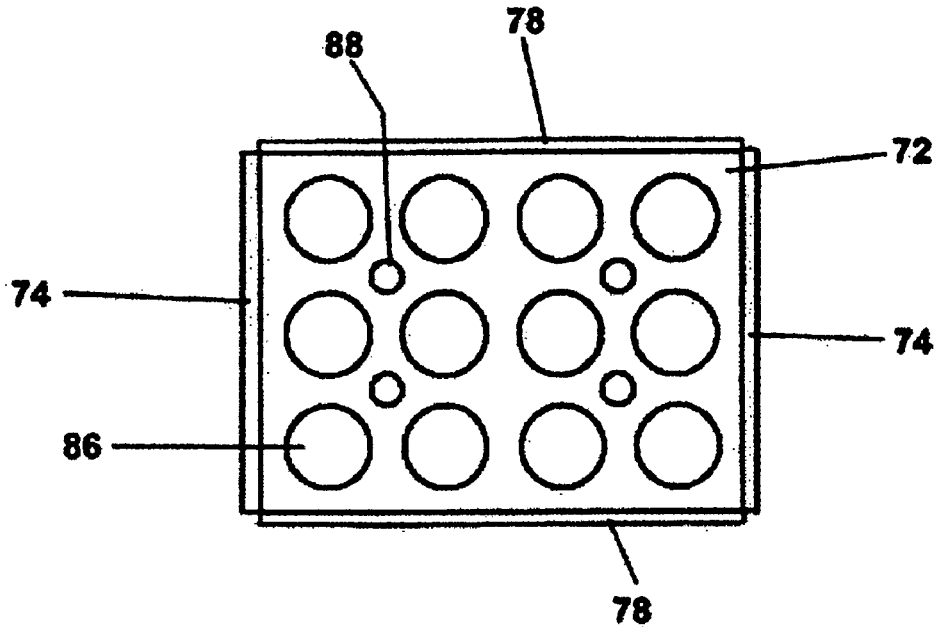
FIG. 4 is a top view of the tray.
Figure 5:
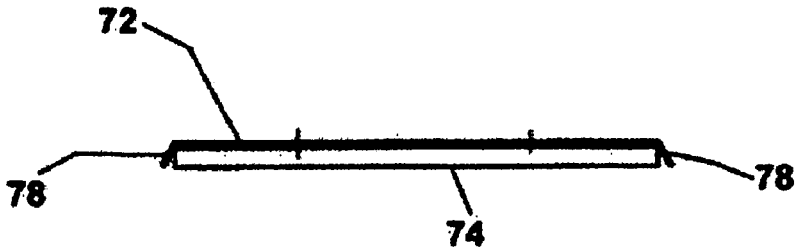
FIG. 5 is a side view of the tray of FIG. 4.
Figure 6:
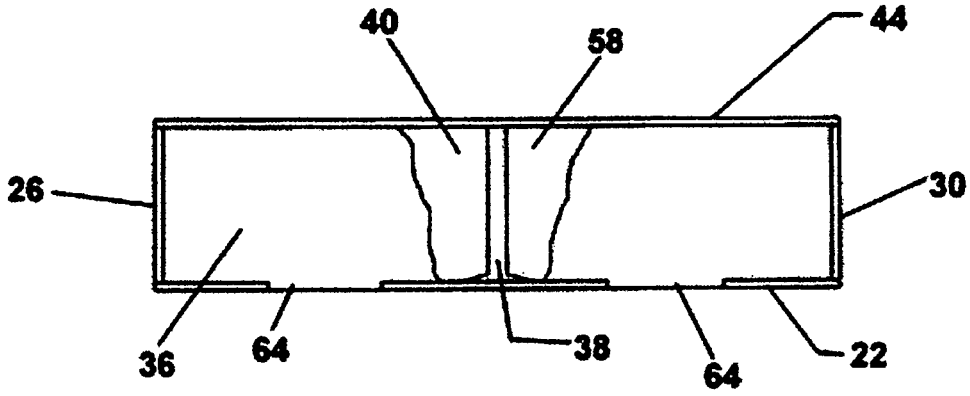
FIG. 6 is a partially sectioned end view of the outer carton taken along line 6-6 of FIG. 10.

Referring to FIG. 3, the insert tray 18 is formed of a single sheet of disposable material such as cardboard. The insert tray 18 comprises an insert blank 70 including a base panel 72 having transverse flaps or legs 74 hingedly connected thereto at transverse score lines 76 and lateral flaps or legs 78 hingedly connected thereto at lateral score lines 80. The base panel 72 includes a plurality of main circular apertures 86 located in a 4 by 3 grid array, for carrying a conventional dozen cupcakes. Intermediate the apertures 86 are smaller diameter apertures 88 providing finger holes for inserting and removing the insert tray 18 from the base of the carton 12. Referring to FIGS. 4 and 5, in assembly the legs 74, 78 are partially folded downwardly about their respective score lines and assume a resilient a downwardly and slightly outwardly inclined orientation. The base panel 72 of the insert 18 is slightly smaller than the upper surface of the base panel thereby forming transverse slots 90 and lateral slots 92 for receiving and capturing the side flaps 54 of the cover panel 44 (FIG. 8) in the transverse slots 90, with the front lateral slot 92 receiving and capturing the front cover flap 50 of the cover panel 44 (FIG. 8).

Figure 8:
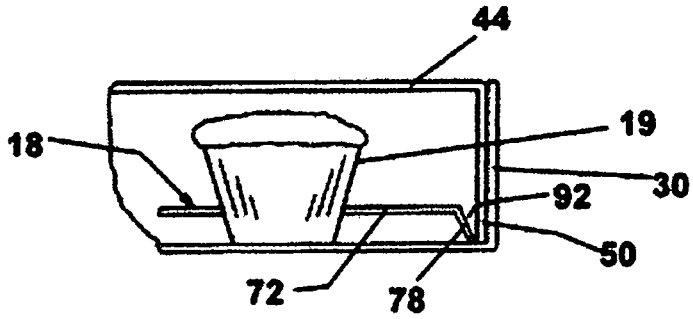
FIG. 8 is a cross sectional view taken along line 8-8 of FIG. 10.
Figure 9:
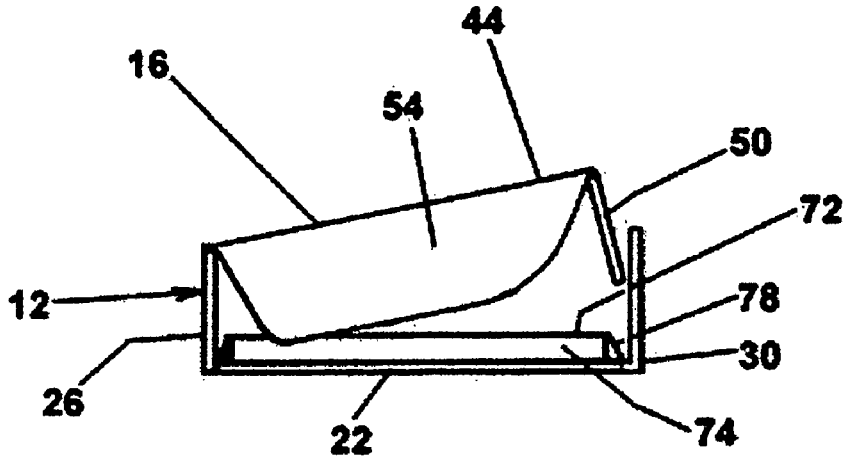
FIG. 9 is a cross sectional view of the cupcake carrier of FIG. 1 in the partially open position.

More particularly, referring to FIGS. 7, 8 and 9, as the lid 16 is pivoted and lowered, the side flaps 54 progressively enter the side slots 90, inwardly biasing the legs 74 of the insert tray, thereby providing frictional and mechanical retention. To avoid sharp edges and promote easy of entry, the side and cover flaps have curvilinear edge surfaces. As the lid is further lowered the cover flap 50 is aligned to slide along the inner surface of the front panel, and progressively enters the front slot 92 and seats as shown in FIG. 8. The flaps thus are securely positioned and resist inward movement upon compression, or other handling disruptions, and additionally reinforce the peripheral walls to provide added protection.

The cupcakes 19 as similar articles are characterized by a generally frustoconical base that may be retained in a pleated liner or wrapper 94. The secure retention of the cupcakes 19 may be further increased by providing a slight compressive fit between the cupcake base and rim of the openings 86. The resulting weight on the insert base also assists in centering the insert to provide uniform gaps for the lid flaps. Inasmuch as typical baking pans provide for a dozen articles, the openings are preferably in the illustrated 4 by 3 grid array. The carrier is accordingly sized. For conventional sized cupcakes, a base of about 13 and 15 inches spaces a dozen cupcakes in the illustrated grid without interference. The base of the insert is sized to provide slots of about ¾ inch, which is satisfactory with acceptable blank thicknesses of about 1/16 to ⅛ inch. Insert flap legs of about ¾ inch provide a low contact location not interfering with the top décor and allow for ease of removal for serving.

While the carrier has been illustrated and described with reference to cupcakes, it will be appreciated that the insert may be configured for other preformed edibles such as muffins, pies and other foods where organizing and protection during storage is desired. After use, the container may be safely disposed or stored in assembled or disassembled condition for reuse.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the spirit and scope of the present invention. The disclosures and description herein are intended to be illustrative and are not in any sense limiting of the invention, which is defined solely in accordance with the following claims.

What is claimed is:

1. A food storage container for a plurality of cupcakes carried in frustoconical liners, comprising: a container member formed of a single sheet of planar material, said container member including a rectangular base, laterally spaced upwardly folded rectangular container flaps at transverse edges of said base forming side walls and transversely folded rectangular container flaps at lateral edges of said base forming front and rear walls, said container flaps in an assembled condition forming a rectangular peripheral wall, said wall and said base forming an upwardly opening cavity, said side walls including a lower section connected with said base and an upper section hingedly connected to said lower section, said front and rear walls including inwardly folded side flaps engaging inner surfaces of said lower sections of said side walls with said upper sections of said side walls being reversely folded over said side flaps and said outer sections to thereby capture said side flaps in an assembled condition wherein said base of said container member includes base slots adjacent said side walls and said upper section of said side walls include projecting tabs for entering said base slots in said assembled condition; a rectangular cover member extending from and hingedly connected to an outer edge of said rear wall of said container member, a pair of downwardly extending folded rectangular cover flaps hingedly connected at the sides of said cover member, said cover member being movable from a closed position overlying said cavity and an open position for accessing said cavity; an insert member formed of a single sheet of planar material, said insert member having a rectangular base member and partially folded downwardly and outwardly extending insert flaps at an outer periphery resiliently engaging at lower ends inner surfaces of said perimeter wall, said base member of said insert member having a clearance with respect to an inner surface of said peripheral wall whereby said insert flaps and said peripheral wall form progressively upwardly opening slots receiving and retaining said cover flaps in said closed position, said insert flaps positioning said base member of said insert member above said base of said container member; circular apertures in said base member of said insert arranged in a grid array and size for lightly compressively engaging said liners of said cupcakes.

2. The food storage container as recited in claim 1 wherein said cover flaps include curvilinear edge surfaces for progressively entering said slots during movement of said cover member to said closed position.

3. The food storage container as recited in claim 1 wherein said apertures are circular for receiving edible articles having frustoconical bases wherein said apertures have peripheral edges sized for lightly compressively engaging said bases of said articles.

4. The food storage container as recited in claim 1 wherein said apertures are positioned in a grid array.

5. The food storage container as recited in claim 1 wherein said cover member includes a cover flap at the front folded downwardly and entering a slot adjacent said front wall.

6. The food storage container as recited in claim 5 wherein said front wall includes an upwardly opening groove exposing a portion of said cover flaps for facilitating manual movement of said cover member from said closed position to said open position.

* * * * *